US007703536B2

(12) United States Patent
Vann

(10) Patent No.: US 7,703,536 B2
(45) Date of Patent: Apr. 27, 2010

(54) GAS ASSISTED LIFT SYSTEM

(76) Inventor: Roy R. Vann, P.O. Box 510, Tyler, TX (US) 75710-0510

( * ) Notice: Subject to any disclaimer, the term of this patent is extended or adjusted under 35 U.S.C. 154(b) by 140 days.

(21) Appl. No.: 12/072,725

(22) Filed: Feb. 28, 2008

(65) Prior Publication Data

US 2008/0257547 A1 Oct. 23, 2008

Related U.S. Application Data

(60) Provisional application No. 60/923,872, filed on Apr. 17, 2007.

(51) Int. Cl.
*E21B 43/00* (2006.01)

(52) U.S. Cl. ..... 166/372; 166/321; 166/370

(58) Field of Classification Search ..... 166/370, 166/372, 321

See application file for complete search history.

(56) References Cited

U.S. PATENT DOCUMENTS

| | | | | |
|---|---|---|---|---|
| 2,380,639 | A | 7/1945 | Eris | |
| 2,948,232 | A | 8/1960 | McCarvell et al. | |
| 3,138,113 | A | 6/1964 | Arutunoff | |
| 3,215,087 | A | 11/1965 | McLeod, Jr. | |
| 3,522,995 | A | 8/1970 | Erickson | |
| 3,630,640 | A | 12/1971 | McMurry et al. | |
| 3,736,983 | A | 6/1973 | Beard et al. | |
| 4,083,660 | A * | 4/1978 | Newbrough | 417/108 |
| 4,711,306 | A | 12/1987 | Bobo | |
| 5,176,164 | A | 1/1993 | Boyle | |
| 5,911,278 | A | 6/1999 | Reitz | |
| 6,497,281 | B2 | 12/2002 | Vann | |
| 6,672,392 | B2 | 1/2004 | Reitz | |
| 2007/0114038 | A1 * | 5/2007 | Daniels et al. | 166/372 |
| 2007/0181312 | A1 | 8/2007 | Kritzler et al. | |

* cited by examiner

*Primary Examiner*—Giovanna C Wright
(74) *Attorney, Agent, or Firm*—C. W. Alworth

(57) ABSTRACT

A gas lift system for use in marginal well and small diameter production tubing is disclosed. The system uses compressed natural (produced) gas to lift formation fluids thereby enhancing produced gas. Incorporated in the system is a plurality of differential pressure control valves which provide the required lift capability for a standard jet pump, located at the bottom of the wellbore, to continue to lift produced fluids. The methods of use are described.

12 Claims, 16 Drawing Sheets

GAS ASSISTED LIFT SYSTEM

This application claims the benefit of priority from U.S. Provisional Application Ser. No. 60/923,872 filed on Apr. 17, 2007.

TECHNICAL FIELD OF THE INVENTION

This system relates to the oil and gas industry and in particular to system for aiding production from marginal gas wells.

BACKGROUND OF THE INVENTION

As an oil and gas field declines—a term used to describe the natural processes that occur in a hydrocarbon field—the wellbore will "water in" and lose formation pressure. "Water-in" is another term of art to explain that formation water will enter the wellbore. The effect that "watering-in" has on the wellbore is to slowly buildup water in the wellbore. Generally, in a newly discovered field, the formation pressure will force produced liquids out of the well bore. This is not the case when the field declines and the liquid head will eventually act to back-pressure the formation inhibiting the further production of hydrocarbon fluids from wellbore unless artificial lift techniques are employed.

In an oil field, as the formation pressure declines artificial lift techniques employing mechanical pumps (surface or downhole), cable lift (see U.S. Pat. No. 6,497,281 to the current inventor), plunger lift (which applies to gas wells), or standard gas lift (which applies to hydrocarbon fluids—oil or oil and gas plus produced water) will be employed. The standard methods work well in most wells, but as the wells really decline, are extremely deep, or if the wellbore serves multiple zones, the standard methods begin to fail or become too expensive, particularly in the case of gas production.

Marginal wells, also called stripper wells, are usually uneconomical for the major oil companies to operate because the labor and pumping costs are close to the revenue from the hydrocarbon sales. Every day many of these unprofitable stripper wells are being shut in, plugged, and abandoned. But there is a type of oil field hand that loves to get possession of these marginal wells because he has the where-with-all to scrounge up enough equipment to maintain and operate these wells at a small profit.

Many of these stripper wells in the U.S.A. produce only about 10 barrels or less, of crude oil per day or about one thousand cubic or less, of gas per day, depending on the type of stripper well. These wells are important to the U.S. economy, especially during times of political unrest when they become vital to our national defense. After all, just one day's production at a rate of 10 barrels, or 420 gal, of oil/day will operate a small auto several thousand miles after the crude oil has been refined into fuel. In a similar manner, a couple of thousand cubic feet of gas will heat a home for several days in mid winter.

Accordingly, it is desirable to make available novel well production equipment that is relatively inexpensive and can be assembled from mostly commercially available material and thereby increase the profit gleaned from a stripper well. Additionally, the novel equipment should be easy to work on and have low cost maintenance and operation. Further, the novel equipment should operate the well in such a manner that the production rate can be increased from marginal to profitable. When all of these and several other desirable attributes are considered, it is easy to see that they add up to a novel well production system that provides the unexpected result of changing an unprofitable situation into one that is profitable.

In the area of stripper gas production, as explained plunger lift has been used successfully as it is reliable and inexpensive to operate; however, as the well really begins to water in and the field pressure declines, plunger lift fails. The industry has tried pumping water, but the cost becomes prohibitive. It is also interesting to note that many gas stripper wells are "multiple completion wells." That is, one wellbore serves several production zones, and as a result there will be one of more sets of production tubing in the wellbore. If a pump jack is used in the small production tubing the sucker rods tend to wear against the tubing walls thereby causing premature failure of the tubing.

The system disclosed by the inventor in U.S. Pat. No. 6,497,281 (Cable Actuated Downhole Smart Pump) could be employed in a wellbore utilizing multiple sets of production tubing. That is to say the continuous cable—without the standard sucker rod joints—operating within the tubing would tend to minimize wear on the tubing. However, such a system would not really be economic as the use of the cable pump is only to remove water and not hydrocarbon fluids for which it was designed.

The prior art is awash with gas lift disclosures. Eris, U.S. Pat. No. 2,380,639—Production of Oil—discloses an improved gas-lift method for the pumping of high paraffin content crude oil (produced fluid) whereby the method reduces or eliminates he deposition of paraffin in the production tubing. The method disperses light hydrocarbons into the production tubing while applying standard gas-lift techniques.

McCarvell et al., U.S. Pat. No. 2,948,232—Gas Lift Methods and Apparatus—disclose a modified standard gas-lift system which uses standard gas lift valves throughout the production tubing but in conjunction with "chamber and control valves" which will impart a pressure surge to the liquid within the production tubing thereby increasing the lifting force.

Arutunoff, U.S. Pat. No. 3,138,113—Multi-stage Displacement Pump—discloses a gas driven multi-stage liquid lift pump placed in the bottom of the production tubing.

McLeod, Jr., U.S. Pat. No. 3,215,087—Gas Lift System—discloses an improved gas-lift method using a standard lift system, but wherein an immiscible fluid is regularly injected into the lifted fluid in order to reduce the tendency of the lift gas to bypass the lifted fluids.

Erickson, U.S. Pat. No. 3,522,955—Gas Lift for Liquid—discloses a unique, but potentially dangerous system for gas-lifting of produced fluids. Erickson 'sends' a flammable mixture of gas and air to a combustion chamber located at the distal end of the production tubing. The mixture is ignited in the chamber and the products of combustion which will be "4-6 times greater in volume" act to lift the produced hydrocarbons.

McMurry et al., U.S. Pat. No. 3,630,640—Method and Apparatus for Gas-Lift Operations in Oil Wells—discloses a unique system to protect standard gas-lift valves in a production string during the initial completion and fitting of a hydrocarbon well. The McMurry concept adds a blocking device to each gas-lift valve which remains CLOSED during the initial completion and cleaning out of the hydrocarbon well. Once the "clean-out" pressure is reduced to the operating pressure, the McMurry blocking valves OPEN (and remain open) thereby allowing the protected gas-lift valves to operate normally.

Beard et al., U.S. Pat. No. 3,736,983—Well Pump and the Method of Pumping—disclose an air driven pumping system in which air flow is cycled to a series of alternating tanks spread throughout the production string which in turn lift the produced fluid.

Bobo, U.S. Pat. No. 4,711,306—Gas Lift System—discloses an improved gas-lift system, similar to McLeod, Jr., in which injection gas is mixed with injection fluid prior to injection into the borehole. The gas and fluid interact with the produced liquid column to lift the column thereby producing the well.

Boyle, U.S. Pat. No. 5,176,164—Flow Control Valve System—discloses an improved gas-lift system utilizing a series of standard gas lift valves located throughout the length of the production tubing with a 'flow control valve' located at the distal end of the production string, essentially the flow control valve is controlled (by the system) from full open to full closed permitting a controlled flow of produced fluids onto the production tubing. Standard gas lift techniques lift the fluid column within the tubing.

Kritzler et al., published U.S. patent application 2007/0181312—Barrier Orifice Valve for Gas Lift—disclose a substantially improved gas-lift valve for use in standard gas-lift systems. The improvement is a pivotable flapper valve that is highly resistant to wear and which will provide positive shut-off during the life of the improved valve.

Reitz in U.S. Pat. No. 5,911,278 discloses a "Calliope Oil Production System," which is designed to produce oil and gas during the declining portion of the field's life. Essentially Reitz uses compressed gas, a string of "macaroni tubing" inserted inside the production tubing within the casing of the wellbore. A series of valves connect to the casing, the production tubing and the macaroni tubing. The series of valves (at least 6 to 10) are then manipulated to send compressed gas down the wellbore and suck on the system. By careful manipulation of these valves, the produced fluid is forced out of the well. In other words there are no mechanical moving parts (other than a check valve located at the bottom of the production tubing) within the wellbore.

In U.S. Pat. No. 6,672,392, Reitz addresses pure gas recovery in an improvement to his earlier disclosure. Again, the system utilizes a complex series of valves and valve operations at the surface to lift the liquid column.

What is required in the industry is a simple system and method to remove produced liquid from a wellbore which has filled with produced fluid thereby allowing gas to freely flow from the formation.

SUMMARY OF THE INVENTION

The instant invention comprises a series of normally open differential pressure controlled valves ("ΔPCV"), which are designed to be placed onto, in communication with, and attached to small tubing. (E.g., 1-inch or larger coiled tubing.) The ΔPCV's are spaced apart on the coil tubing at a given distance which is readily determined by a simple head/drive pressure formula. An eduction valve (or jet pump) is placed on the distal end of the coil tubing and the coil tubing is run into the existing production tubing which itself may be retained by a hold down or packer at the bottom of the production tubing. The eduction valve—retained by the small (or coiled) tubing—is placed just above the seating nipple.

Compressed gas is passed into the production tubing, which surrounds the smaller tubing, and passes down the larger tubing until it reaches the fluid level. At this point, the fluid level is depressed by the gas pressure and the fluid passes into the smaller tubing at the uppermost normally open ΔPCV. When the retreating fluid level reaches the uppermost valve, gas will pass through the ΔPCV thereby pushing the fluid, in the small tubing, to the surface. (Essentially the gas acts like a coffee percolator lifting the fluid to the surface.) As the fluid level in the smaller tubing drops to the same level as the uppermost ΔPCV, the uppermost valve closes and remains closed.

At this point the second valve in the string will accept liquid flow and the process repeats. This process will repeat until all the ΔPCV's are closed and the formation liquid now appears at the wellbore bottom where the eduction valve or jet pump takes over to move liquid to the surface. Produced gas from the formation is now free to flow up the one-inch tubing to the surface under formation pressure.

If the gas compressor goes down, for what ever reason, movement of produced liquid will cease and the hydrostatic head will rebuild throughout the wellbore thereby inhibiting gas production. When the compressor is brought back on line, the ΔPCV's will act to lift the liquid thereby restoring gas production.

Finally, because one of the most common problems in pumping water from gas wells is deposits of salt and scale into the orifice (⅛" opening), the ΔPCV system is designed to allow fresh water with gas to be reversed down the smaller (lift) tubing and into the larger production tubing to remove partial plugging. Thus, any build of deposits in the system components can be reverse pumped back to the surface through the production tubing, for disposal, either manually or automatically, if the control system is set to incorporate this automatic feature.

Note the lack of valves when compared to the prior art, unless the optional reverse flush is incorporated.

Figure 5:
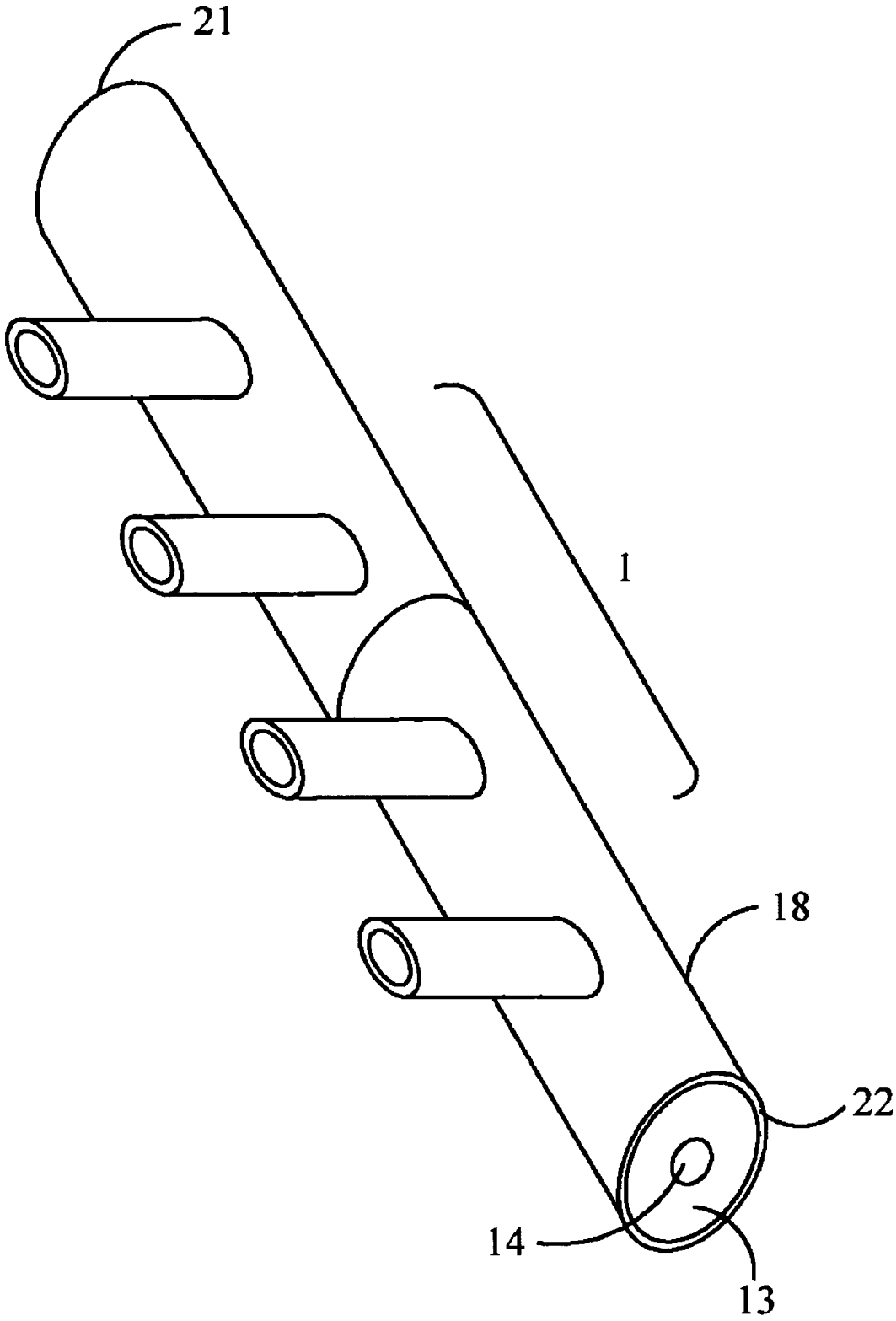

FIG. 5 is an isometric view of the ΔPCV valve.

Figure 6:
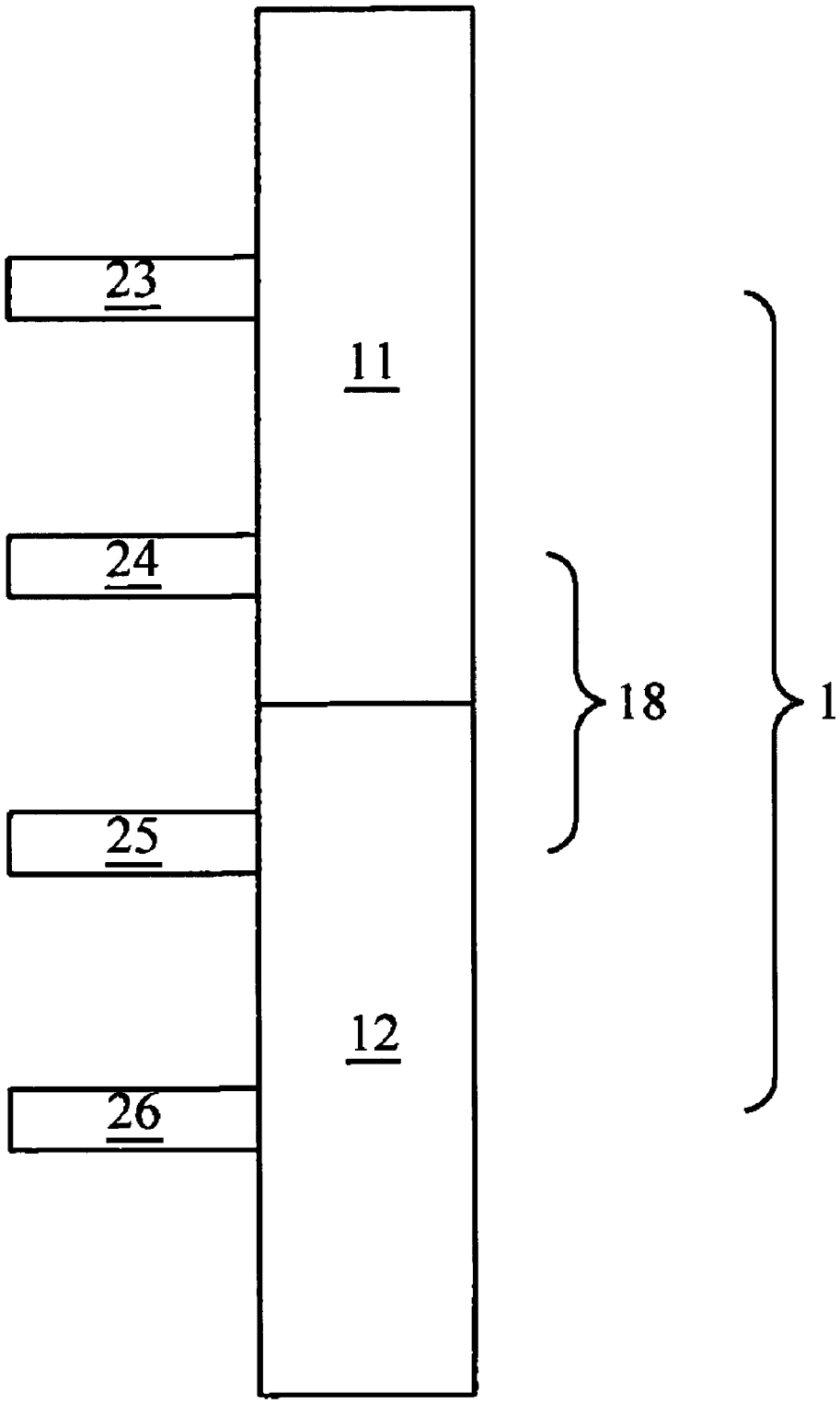

FIG. 6 is a side view of the ΔPCV valve.

Figure 7:
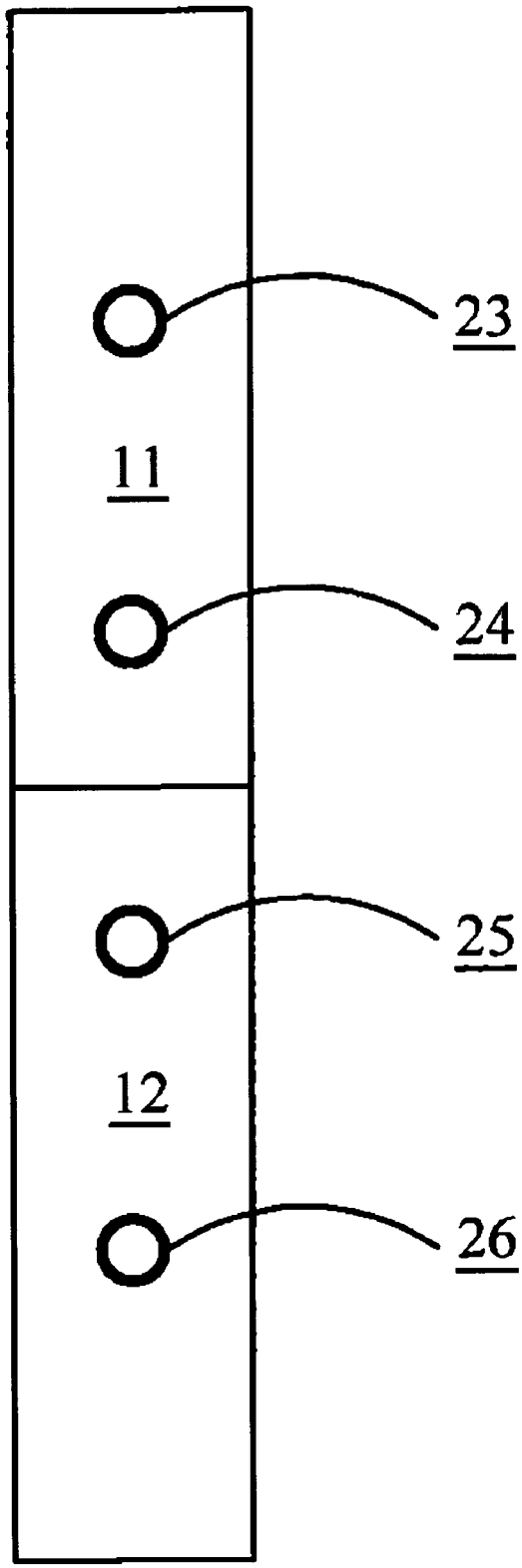

FIG. 7 is the same as FIG. 6 but rotated by 90-degrees CCW.

Figure 8:
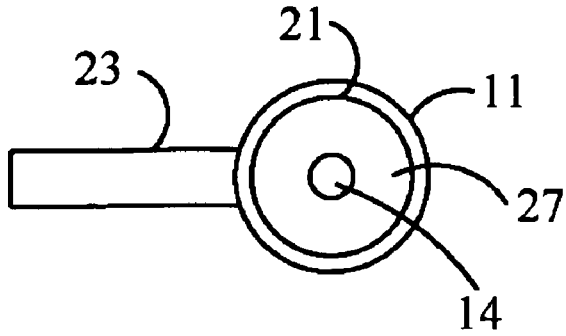

FIG. 8 is a top view of the ΔPCV showing the upper end of the internal shuttle valve.

Figure 9:
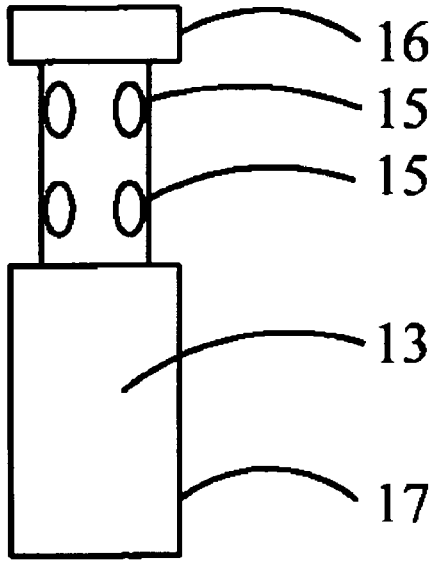

FIG. 9 shows a side view of the internal shuttle valve.

Figure 10:
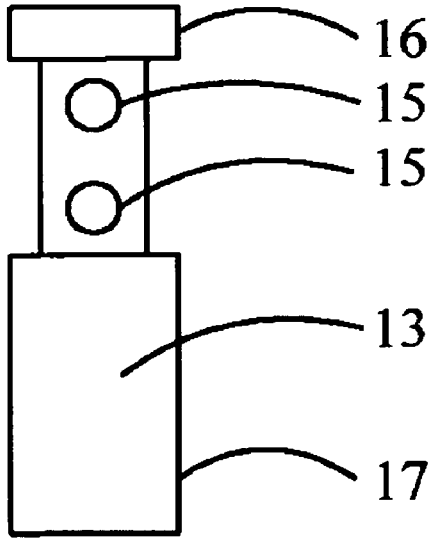

FIG. 10 is similar to FIG. 9, but rotated by 90-degrees.

Figure 11:
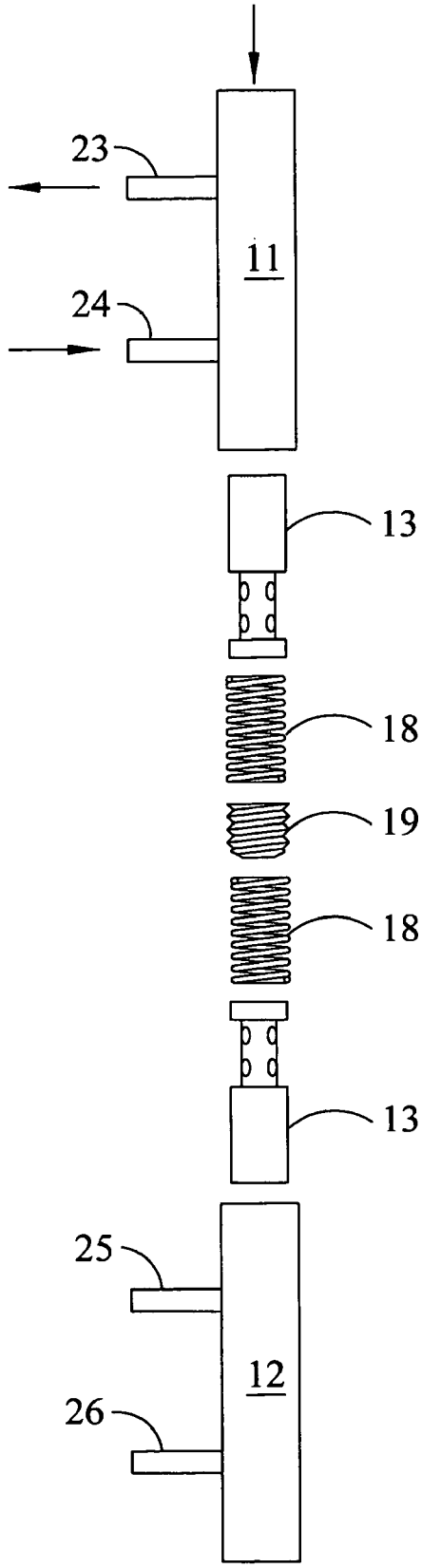

FIG. 11 is an exploded view of the ΔPCV valve.

Figure 12:
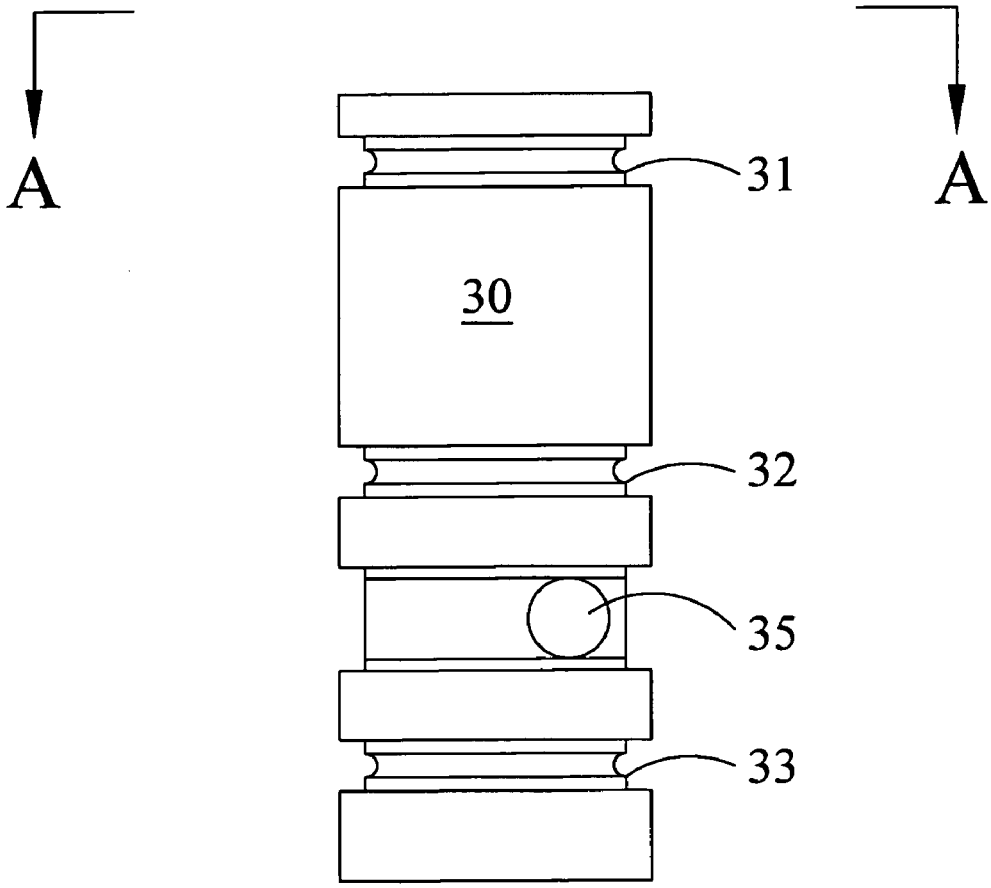

FIG. 12 is a side view of an alternate embodiment internal shuttle valve of the ΔPCV valve showing a variation in the seal arrangement.

Figure 12A:
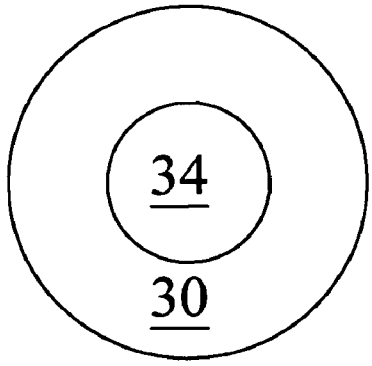

FIG. 12A is a cross-sectional view of FIG. 12 taken at A-A.

Figure 13A:
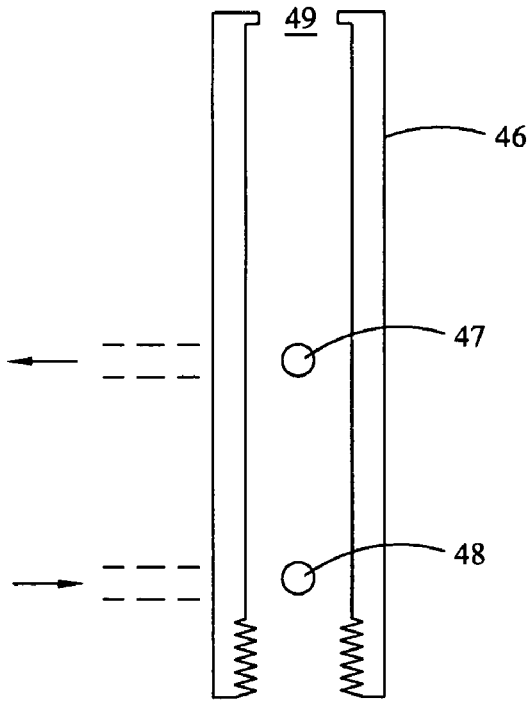

FIG. 13A is a cross sectional view of the body of a single part ΔPCV valve in which the embodiment of FIG. 12 operates.

Figure 13B:
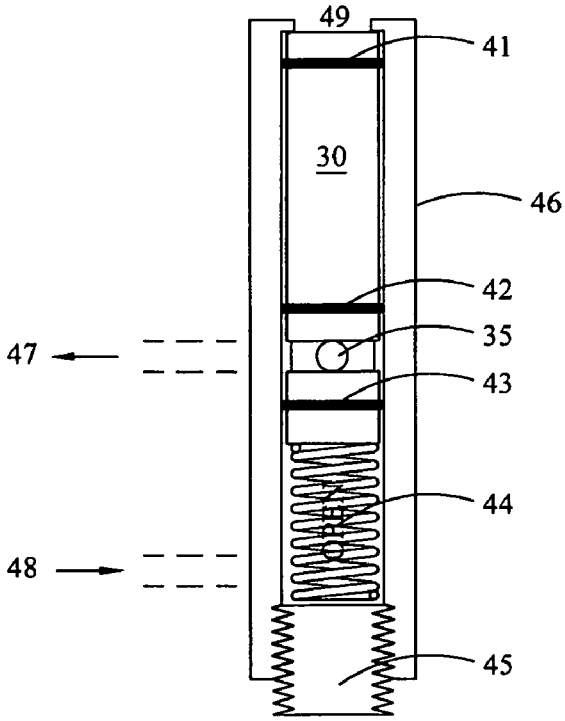

FIG. 13B is the same as FIG. 13A but with the shuttle valve in place within the body and in the open position.

Figure 13C:
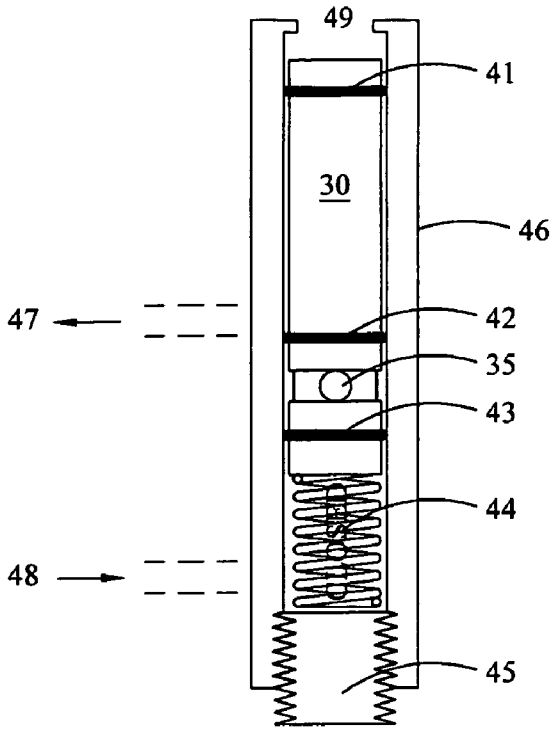

FIG. 13C is the same as FIG. 13A but with the shuttle valve in place within the body and in the closed position.

Figure 14:
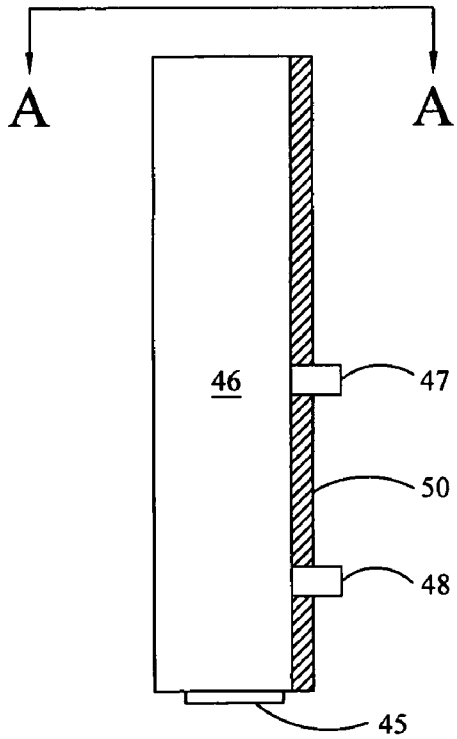

FIG. 14 is a side view of the single part ΔPCV valve of FIG. 13, rotated 90-degrees and showing the ports and sealing system.

Figure 14A:
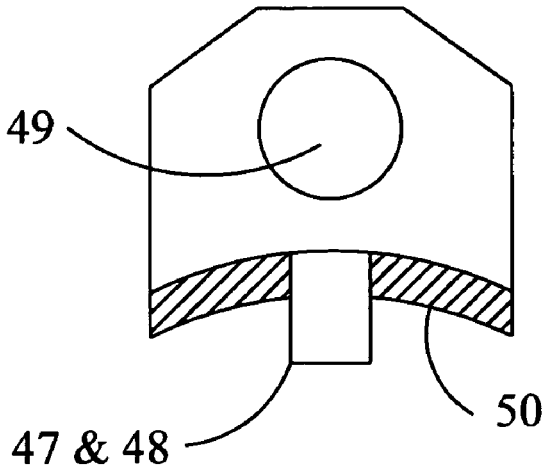

FIG. 14A is a cross-section taken at A-A in FIG. 14 showing the upper aperture and sealing system.

Figure 15:
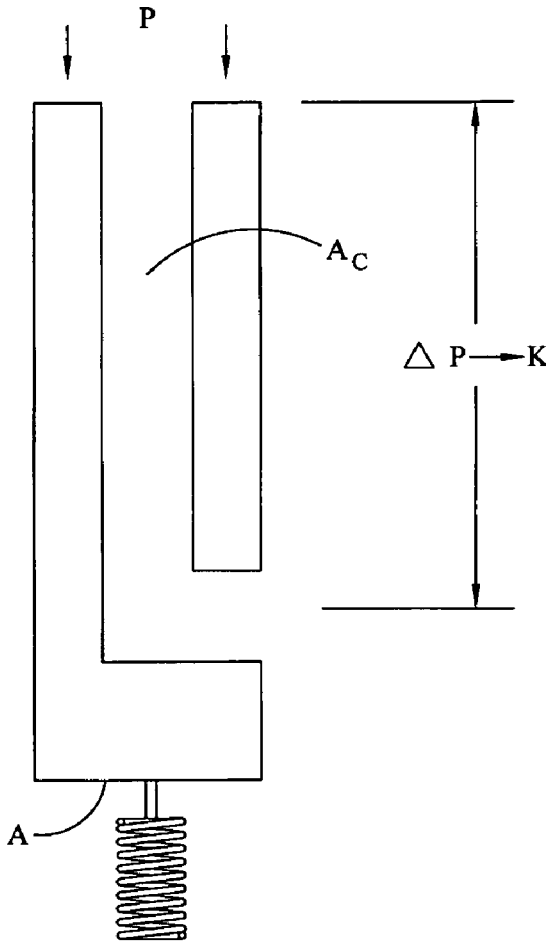

FIG. 15 is a free body cross-sectional diagram of the ΔPCV shuttle showing cross-sectional areas, the spring bias and the point at which ΔP exists across the shuttle.

DESCRIPTION OF THE PREFERRED EMBODIMENT

Figure 1:
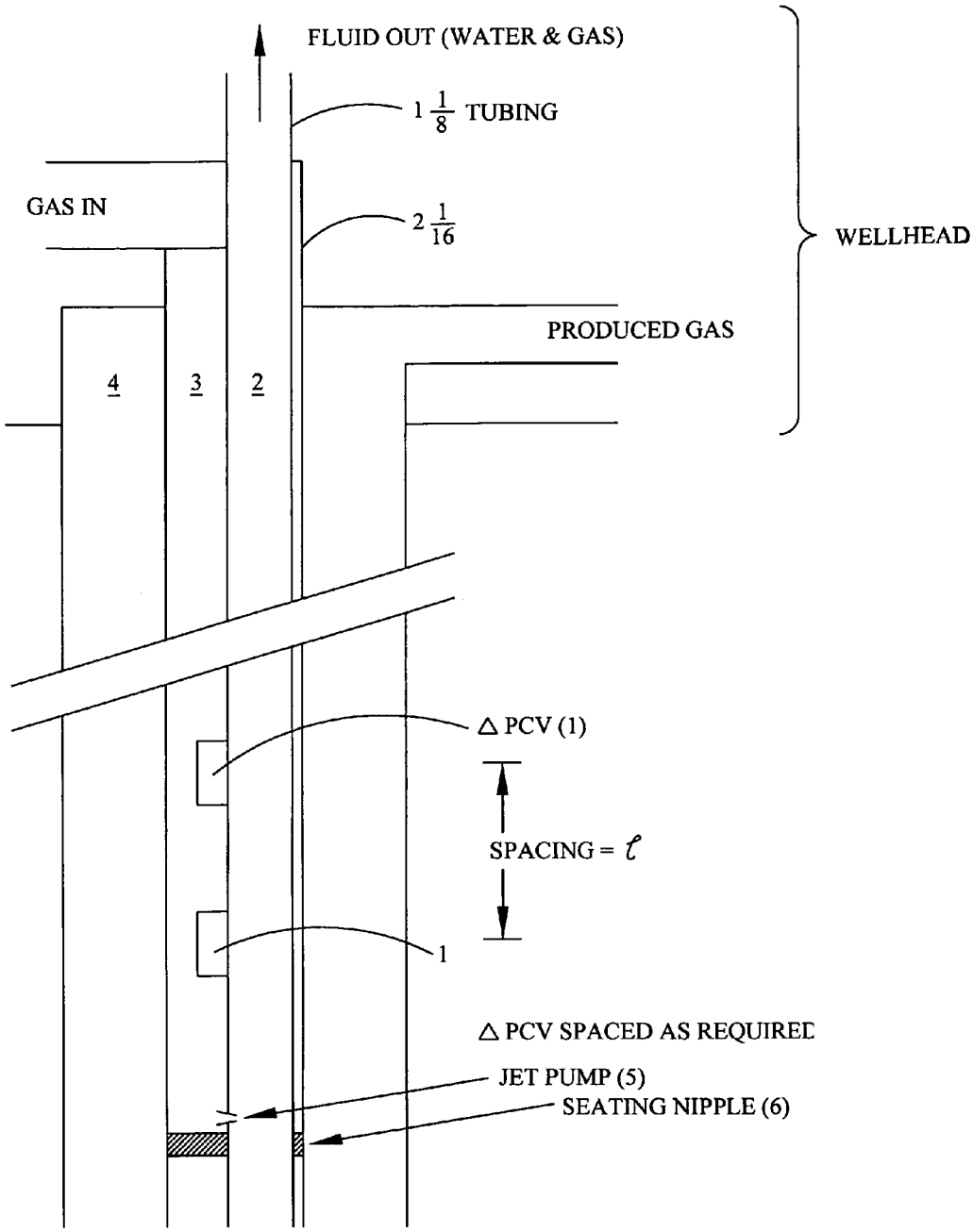
FIG. 1 shows a simplified illustration of the instant invention with 1¼-inch tubing holding the ΔPCV's with an eduction valve or jet pump at its distal end terminated in a seating nipple and shown within 2⅜-inch production tubing. This being the most common arrangement.

The lift apparatus is shown is shown in FIG. 1 and comprises a lift tube, 2, with a jet or eduction pump, 5, attached to its distal end and seated in a seating nipple, 6. The lift tube is shown with a plurality of ΔPCV valves, 1, attached to the lift tube with spacing "l." The lift tube is inserted within a production tubing string, 3, which in turn is within the wellbore or annulus, 4. It is possible to place the lift tube directly into the casing that does not have a production string. As can be seen in FIG. 6, the ΔPCV valve, 1, has four conduit, 23, 24, 25 and 26, extending from the valve base, 18, which are designed to be accepted by corresponding apertures in the lift tubing thereby placing the internals of the valve in communication with the inside of the lift tube. The valve may be held in place by a clamp (not shown) or by seals acting between the valve conduit and the lift tube apertures.

The spacing "l" is set by a simple relationship that 500 psi gas will displace 1000 feet of hydrostatic head. Thus, the spacing is set by the expected head and the operating pressure of the lift gas which is supplied by a compressor located on the surface (see FIG. 4) and which passes through production tubing, 3, as shown in FIG. 1.

Figure 2A:
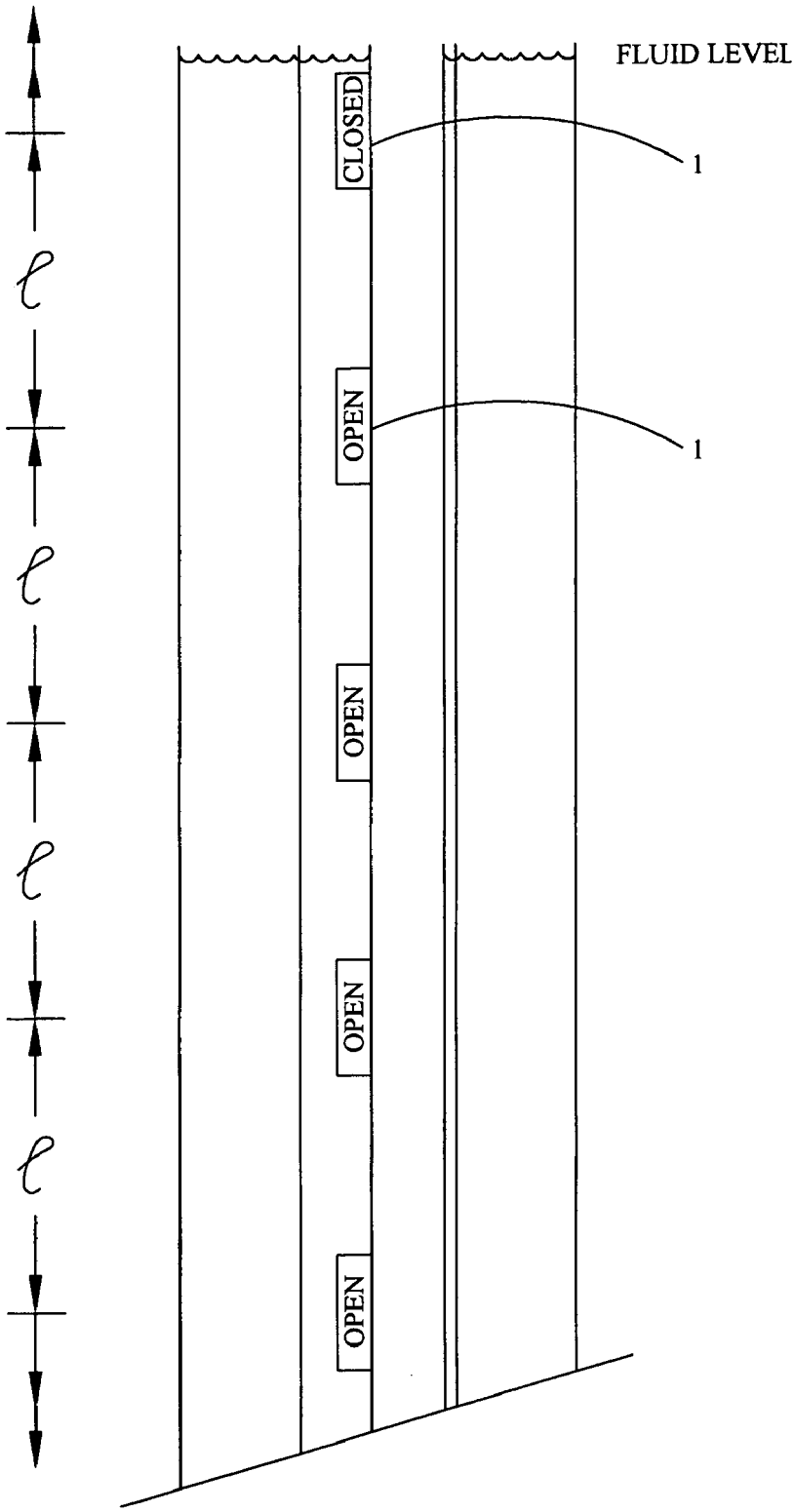
FIGS. 2A through 2D show how the hydrostatic head is passed through the ΔPCV's and into the smaller lift tubing. It should be understood that gas pressure lifts the hydrostatic head.
Figure 2B:
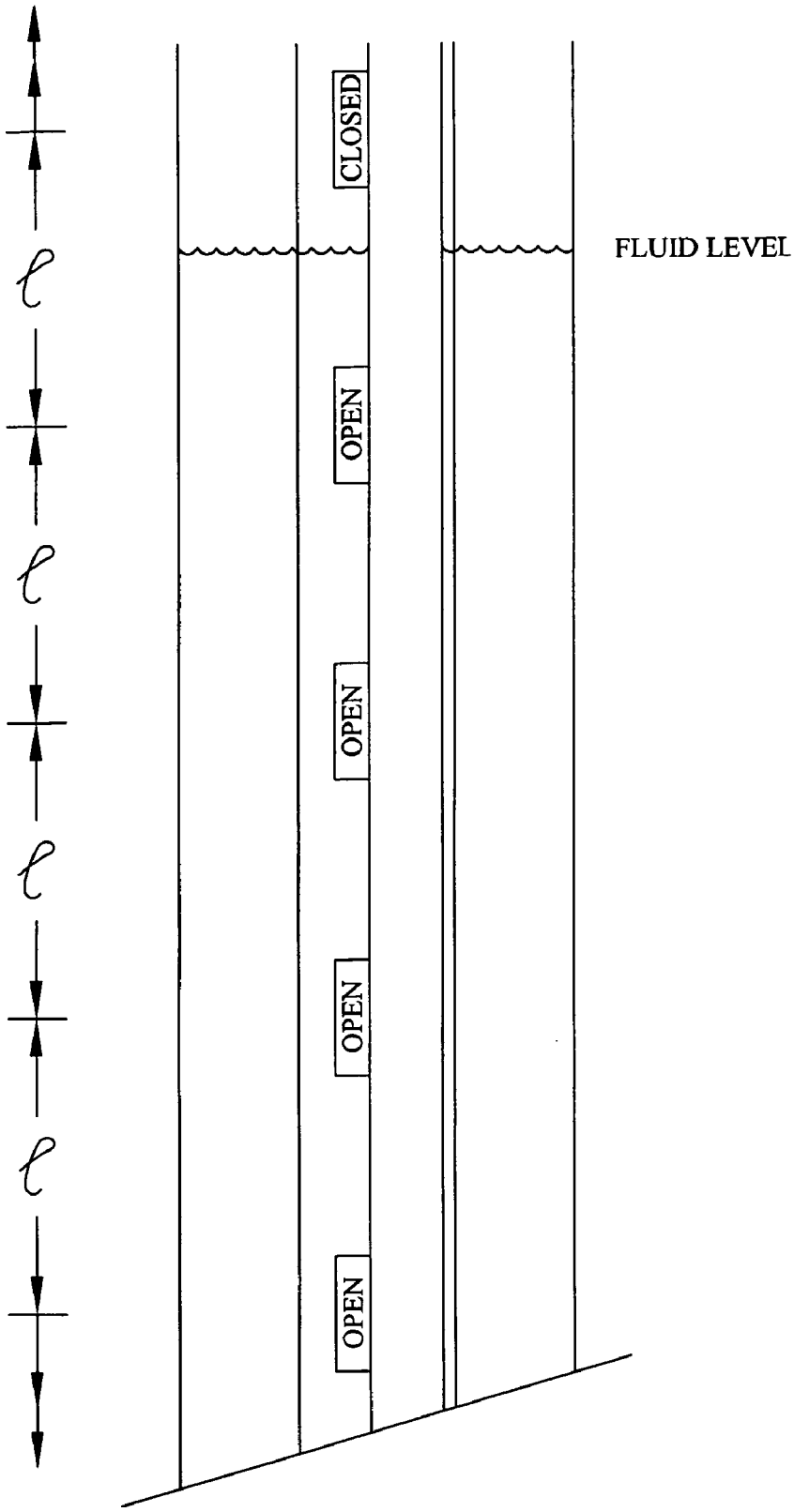
Figure 2C:
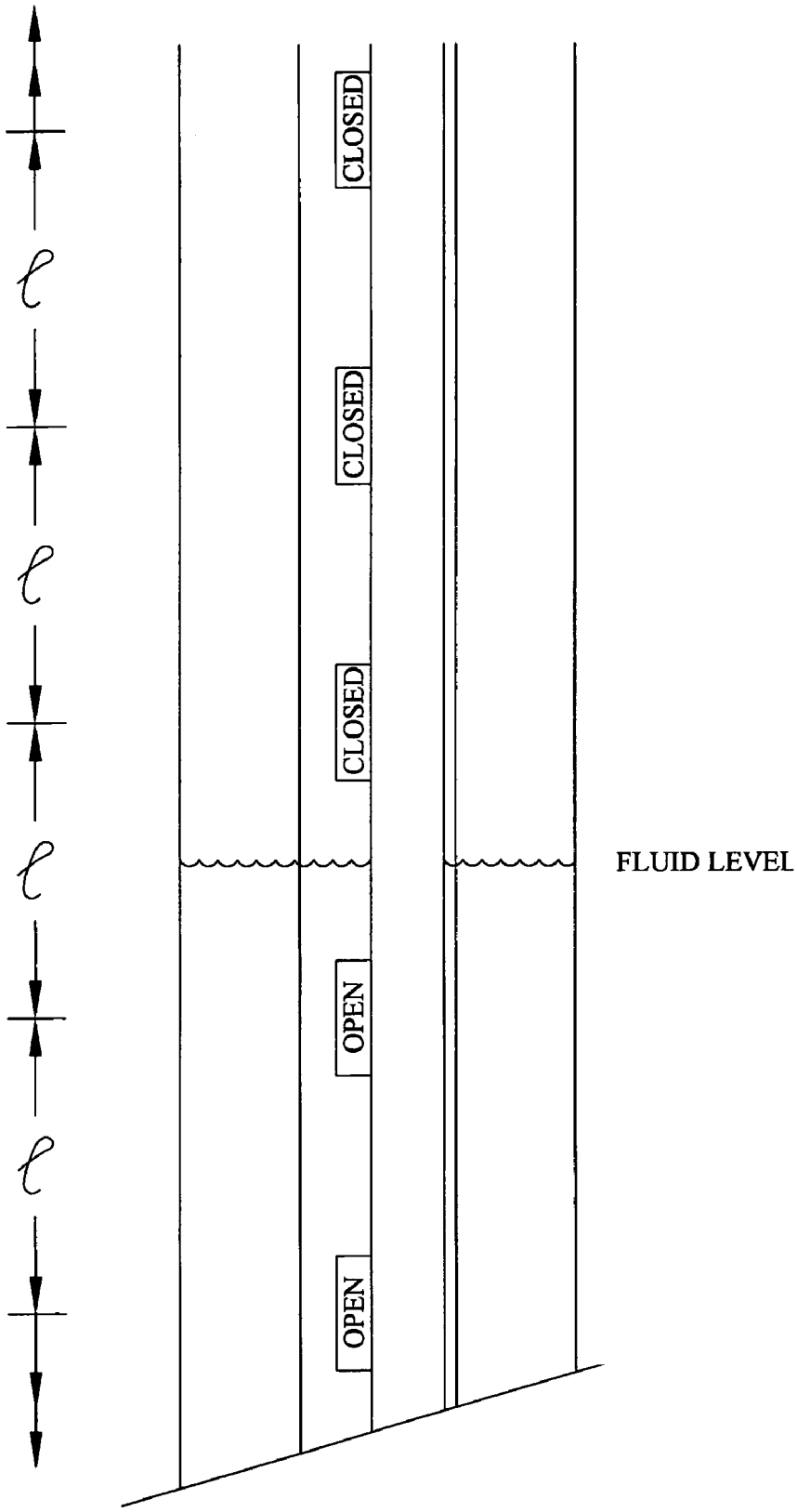
Figure 2D:
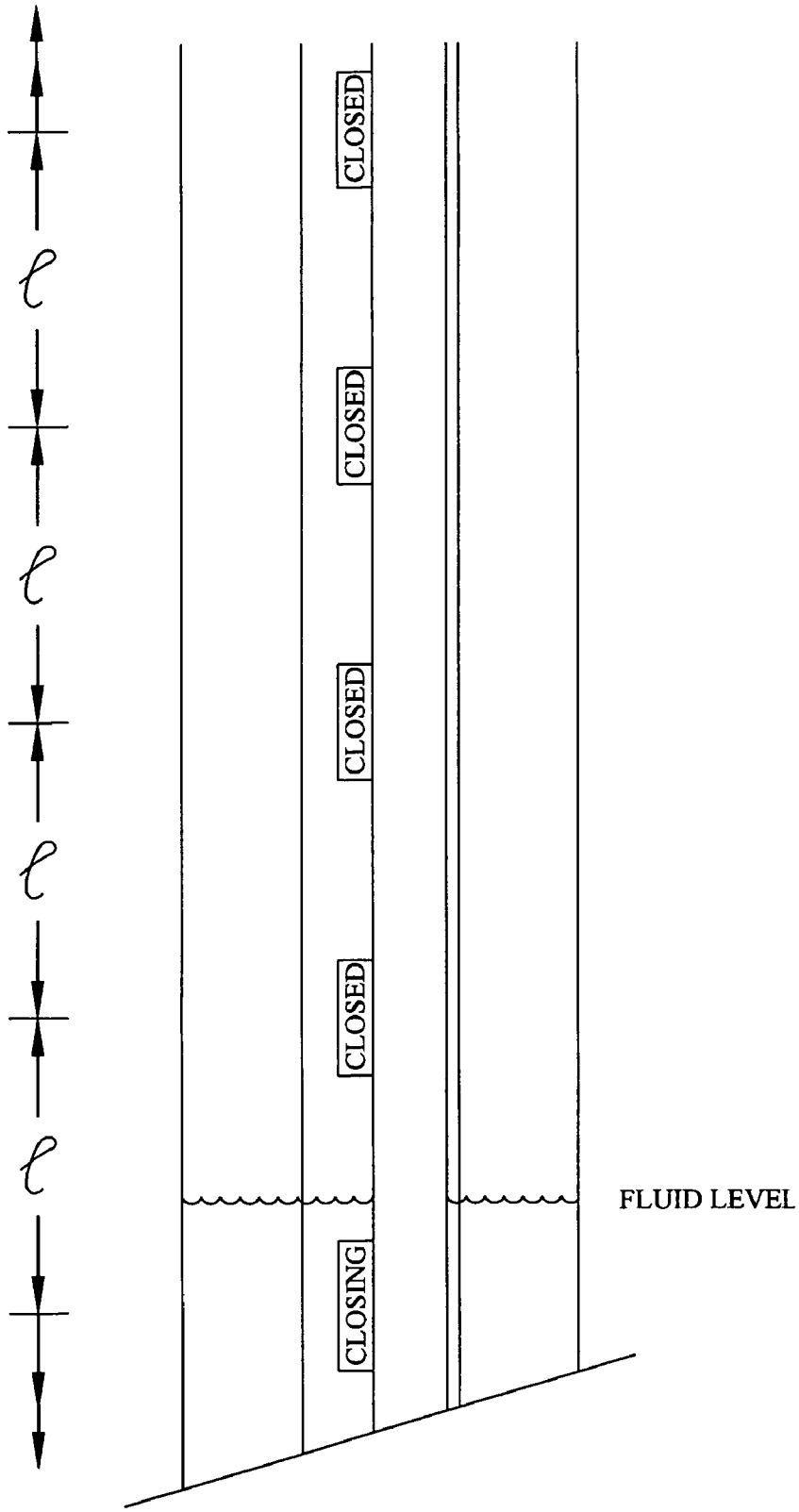
Figure 3:
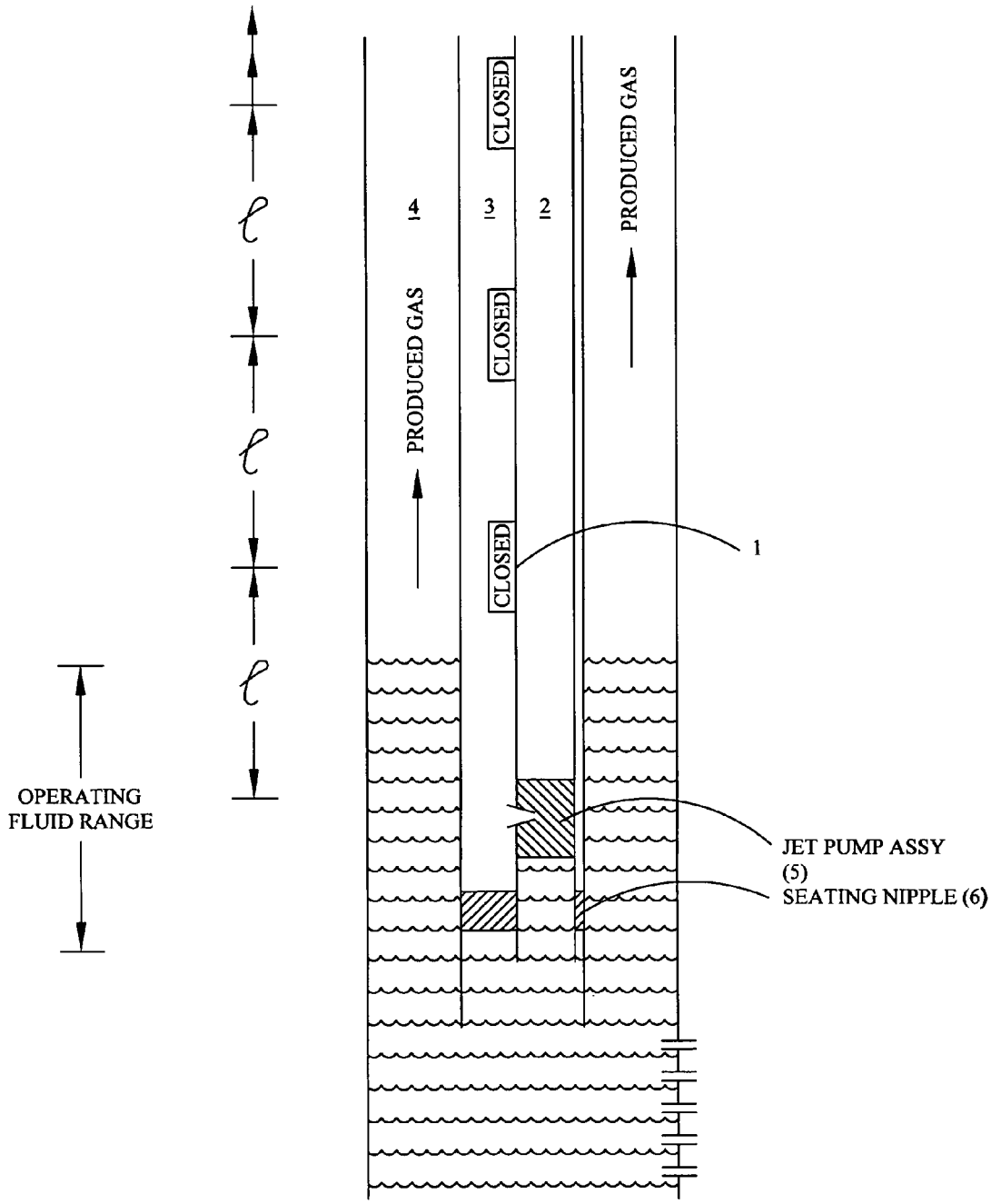
FIG. 3 shows the liquid level at or near the bottom of the production tubing and being maintained by the eduction valve or jet pump thereby allow produced gas to pass up the coil tubing or casing if no packer is run. It should be understood that since packers are run in most wells that gas and liquid (fluids) may also move through the coil tubing

Turning now to FIGS. 2A through 2D, assume that FIG. 2A shows the starting level of liquid within the wellbore. Now allow gas, under pressure, to be applied to the production string, 3. The pressure of the gas will force the liquid through the uppermost valve, 1. As the level approaches this valve the pressure difference between the production tubing and the inside of the lift tube rises thereby closing this particular valve. The valve immediately below this valve sees the spacing head l plus the gas pressure which means the valve will be open (as will other valves below). When the liquid level reaches this valve: it too will close. Thus, the liquid level is displaced slowly, but surely, downward and blown up through the lift tube to the surface as shown through FIGS. 2A-2B with the liquid finally settling near the bottom of the annulus as shown in FIG. 3.

At this point, the produced liquid is picked up and transported to the surface, through the lift tube by a standard eduction valve or jet pump, 5, using techniques well known in water, oil and other types of fluid lift to a fluids recovery system (e.g., a separator and associated standard industry equipment). This system, or method, uses a plurality of ΔPCV valves to reduce the hydrostatic head in a wellbore to the point that a standard jet pump or eduction valve may be used to produce a well.

Turning now to FIGS. 5 through 11, the ΔPCV valve will be described. The valve shown in the Figures is a dual valve, in other words, there are two valves in a single body. This is simply because of ease of manufacture. A single valve may readily be used, as could a triple, or more, valve. Thus, the claims of this disclosure should be interpreted as such.

The dual embodiment is shown in FIGS. 5 through 11 and comprises an upper body, 11, adapted to be attached to a lower body, 12, thereby forming the overall body, 18. Conduit 23, 24, 25 and 26 are in communication with the inside of the body. A shuttle, 13, is contained within the upper body and the lower body and slides within apertures 21 or 22 respectively. The two bodies are joined together by screw fitting, 19. Two springs, 18, press against the screw fitting and their respective shuttle. These springs set the required differential pressure (along with the aperture, 14, and the upper area, 27, of the shuttle, 13, to close the ΔPCV. A seal means 16 and 17 acts between the shuttle valve and the inside aperture (21 or 22) of the respective body (11 or 12) to prevent fluid passage.

When the valve is open (normal condition), fluid may enter the valve through aperture, 14, pass through openings, 15, and through conduits, 23 or 26, into the lift tubing. (Remember there are two shuttles within each valve—although the valve may be terminated in screw fitting, 19, without a second section. Lift tube pressure is applied against the lower (closed-in) part of the shuttle which is against the spring via conduits 24 or 25. The spring biases the shuttle valve so that it is open. When the conduits 23 and 24 and 25 and 26 see the same pressure, the area difference overrides the spring bias and the shuttle shifts, thereby opening the valve.

The single embodiment, utilizing the alternate sealing arrangement for the shuttle valve described later, is shown in FIGS. 13 through 14.

At this point, the reader should now be able to understand the clear difference between the instant invention and the prior art gas lift. In the instant invention the ΔPCV remains open until the differential pressure across the valve approaches the offset value set by the spring bias. When the pressure across the valve is equal to or less than the offset value, the valve remains closed. In standard gas-lift, the lift valve is a pure check valve and differential pressure across the valve has no effect in closing the valve and keeping it closed. The standard—prior art—lift valve acts to admit lift gas into the production string and percolates the fluid; whereas the ΔPCV acts to admit liquid into the production string so long as there is liquid head above the ΔPCV in question in the annulus (or lift tube).

The above point can best be understood by looking at FIG. 15, which is a free body diagram of the shuttle valve and the spring. Area A is the area on the bottom of the shuttle and area $A_C$ is the area of the central conduit in the shuttle valve. When the ΔPCV is open the area presented to the lift gas pressure is $A-A_C$. When the valve is closed the area presented to the lift gas pressure is A. Remember, the lift gas pressure appears at the TOP of the shuttle (top of the valve—see FIGS. 11, 13 or 14). When the ΔPCV is closed, there is no flow of lift gas and the effective area presented to the lift gas is the entire area of the shuttle.

Now the pressure exerted on the bottom of the shuttle is equal to the liquid head above the valve h and the area presented is A (constant). Thus the force to hold the ΔPCV open is:

$$(AH+K)lb_f$$

where H is the equivalent pressure due to liquid head h and where K is the spring bias.

The force required to close the ΔPCV is:

$$GP(A-A_C)lb_f$$

where GP is the lift gas pressure.

For sake of argument allow the lift gas pressure (GP) to be 500 psi, and allow h to be 1000 feet reducing to zero (0). The pressure exerted by 1000 feet of water is roughly 433 psi, thus H=433 psi which will reduce to almost zero when the water is displaced. If fact, let us assume zero back pressure. In a working ΔPCV, the shuttle OD is ⅜-inch and the conduit ID is ⅛-inch and the average value of K is about 33.5 $lb_f$. Thus the force closing the valve is:

$$(433)[\pi[3/16]^2-\pi(1/16)^2]lb_f=42.51\ lb_f$$

The force acting to keep the ΔPCV open is:

$$H\pi[3/16]^2+K$$

If this force is less then the force acting to close the ΔPCV, then the ΔPCV is open. But we have said that H goes to zero, thus if K>42.51 $lb_f$, the ΔPCV is open. Equating the opening force to the closing force we can solve for H which is about 81.5 psi or 189.5 feet of liquid head. Thus, under this scenario the ΔPCV will close when there is about 189 feet of liquid above the ΔPCV.

An alternate and preferred sealing arrangement for the shuttle valve, 33 (13 in FIGS. 8-11), is shown in FIGS. 12 and 12A. Rather than employ labyrinth seals (as shown in FIGS. 8-11 as items 16 and 17), a series of o-rings (not shown in FIG. 12, but shown as 41, 42, and 43 in FIG. 13) are employed within the ΔPCV and placed within the o-ring grooves, 31, 32 and 33. The o-rings then seal between the shuttle and the inside of the ΔPCV (1). Aperture 35 is in communication with aperture 34, similar to apertures 15 being in communication with aperture 14 in the shuttle valve of FIGS. 8 through 11 as described above. (See also FIG. 15.)

An alternate embodiment of the ΔPCV utilizing a single shuttle within the ΔPCV is shown in FIGS. 13-14. Like the dual embodiment, the ΔPCV consists of a body, 46, with an aperture, 49, at the upper end (with reference to FIG. 13A) and a threaded end (un-numbered) at the lower end of the body. A threaded plug, 45, is received by the threaded end of the body. The shuttle valve, 30, is inserted within the body, 46, a spring, 44, is placed under the shuttle, 30, and the plug, 45, and is screwed in place. (It should be noted that the plug may be crimped or otherwise positioned within the body.) The single ΔPCV embodiment, like the dual embodiment, has an open position (as shown in FIG. 13B) and a closed position (as shown in FIG. 13C. In the open position, fluid flows from the production tubing, 3, through aperture 49, through conduit 34 in the shuttle, through aperture 35 (which is in communication with conduit 34) and through conduit 47 and into the lift tube, 2. At the same time, the lift tube pressure is applied through conduit 48 to the bottom of the shuttle. As explained earlier, when the differential pressure between aperture, 49, and conduit 48 exceeds the spring (44) bias, the ΔPCV closes (as shown in FIG. 13C).

FIG. 14, although showing the single ΔPCV embodiment, illustrated the preferred embodiment for sealing the ΔPCV against the lift tube, 2. (See FIG. 1) Essentially the preferred seal comprises a flat piece of neoprene or equivalent, 50, (with appropriate openings for conduit 47 and 48). The seal, 50, seals between the ΔPCV (generally 1) and the lift tube, 2.

If the gas compressor goes down, for what ever reason, movement of produced liquid will cease and the hydrostatic head will rebuild throughout the wellbore thereby inhibiting gas production. When the compressor is brought back on line, the ΔPCV's will act to lift the liquid thereby restoring gas production.

As noted in the summary, one of the most common problems in pumping water from gas wells is deposits of salt and scale into the orifice (⅛" opening), the ΔPCV system is designed to allow fresh water with gas to be reversed down the smaller tubing and into the larger production tubing to remove partial plugging. Thus, any build of deposits in the system components can be reverse pumped back to the surface through the production tubing for disposal. In order for this reversal process to work, a check valve would need to be placed into the inlet of the jet pump to keep fluid from flowing back into the annulus.

Figure 4:
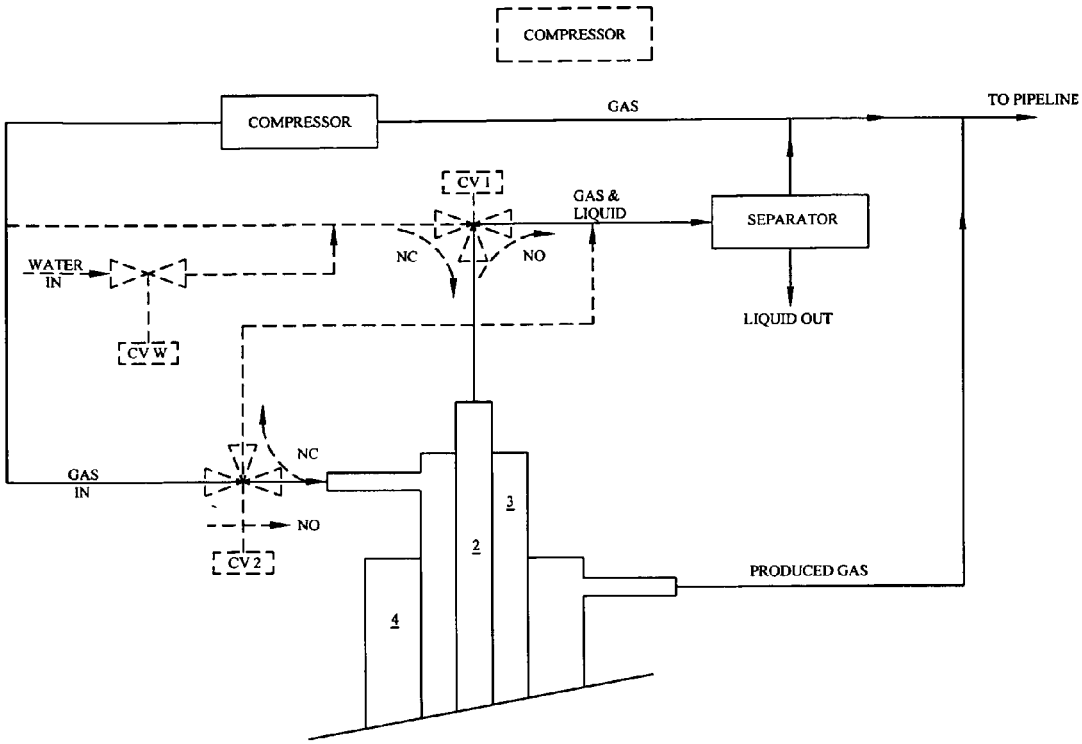
FIG. 4 is a simplified illustration of the wellhead showing a simple process diagram.

Referring now to FIG. 4, the dotted lines show the piping and control system arrangement for optional reverse flushing of the system. Valves, CV1 and CV2 are three way control valves. CV1 in its normally open position allows gas and liquid to flow from the smaller tubing, 2, to the separator, and CV2 in its normally open position allows gas to flow from the compressor into the production tubing, 3. Shown in the compressor outlet line is a source of high pressure water which is controlled by valve CVW. When reverse flushing is required, the operator would manually switch the positions of the two control valves, CV1 and CV2, and open the high pressure water valve, CVW. This then allows reverse flow and will sweep the orifices clean. The manual operation can readily be automated and the system controls programmed to reverse flush on a time schedule or on back-pressure. It should be realized that production would have to cease and the well allowed to stabilize (i.e., the formation fluid would have to come to its normal, un-lifted level, so that the differential pressure control valves would open. In the alternative to valves, the surface plumbing can be manually reversed whenever the need for cleaning arises and water added.

As stated earlier, it is possible to use the gas lift system directly in a well that does not have a production string. It is unusual to produce a well through the annulus and not use a production string. If such an opportunity exists, the lift tubing of the instant invention, along with its associated differential pressure control valves and distal end eduction pump (jet pump) would be directly run in the casing and stab into a packer located near the distal end of the casing. The packer would be located above the casing perforations. Thus, the lift tube will act as a production string substitute. Pressured gas would be applied to the casing (annulus), 4, and the differential control valves would operate to lower the liquid level in the casing and lift tube as earlier described. When the liquid level is reduced to the eduction pump level, the eduction pump would then continue to lift liquid and allow all produced fluid to pass up the lift tube. In a similar manner the system may be reversed flushed by applying pressured gas and water to the lift tube. This embodiment of the gas assisted lift system is not seen as preferred, but can serve a purpose in old shallow wells.

There has been disclosed two embodiments for a gas lift differential pressure control valve, two embodiments for seals within the control valve, and two embodiments for a gas lift system using a differential control valve. It should be apparent to those skilled in the art that other techniques may be utilized to create seals with the differential pressure control valve, manufacture the differential pressure control valve, and seal the differential pressure control valve to the lift tubing. Such techniques are considered to be within the spirit of this disclosure. It should be further apparent that the lift system and the control valve are mutually inclusive.

The instant invention has been described in terms of coiled tubing which is the preferred technique for running additional tubing within the well. It should be realized that standard tubing may be used and the claims are written to include both techniques.

The invention claimed is:

1. I claim a gas lift system comprising;

a lift tube having an inside, an outside, a top end and a distal end being placed within a production string said top end in communication with a recovery system;

a plurality of differential pressure control valves each having the same differential operation pressure adapted to be attached to said lift tube such that said inside of said lift tube is in communication with said production string through each of said differential pressure control valves and wherein fluid contained within said production string may freely pass into said lift tube through each of said differential pressure control valves when open and such that each of said differential control valves will close whenever the decreasing pressure within said lift tube approaches the pressure within said production string;

a jet pump attached to the distal end of said lift tube said jet pump adapted to lift liquids up said lift tube whenever gas is applied therewith; and a source of pressured gas applied to said production string.

2. The Gas Lift System of claim 1 wherein said lift tube is coiled tubing.

3. I claim a gas lift system comprising;

a lift tube having an inside, an outside, a top end and a distal end being placed within an annulus with said top end in communication with a recovery system;

a plurality of differential pressure control valves each having the same differential operation pressure adapted to be attached to said lift tube such that said inside of said lift tube is in communication with said annulus through each of said differential pressure control valves and wherein fluid contained within said annulus may freely pass into said lift tube through each of said differential pressure control valves when open and such that each of said differential control valves will close whenever the decreasing pressure within said lift tube approaches the pressure within said annulus;

a jet pump attached to the distal end of said lift tube said jet pump adapted to lift liquids up said lift tube whenever gas is applied therewith; and a source of pressured gas applied to said annulus.

4. The Gas Lift System of claim 3 wherein said lift tube is coiled tubing.

5. I claim a differential pressure control valve for use with a gas lift system comprising a body having an inside, an outside, topside and a bottom side;

an upper and lower conduit in communication with said inside of said body;

a shuttle contained within said body and adapted to move between said topside and said bottom side thereof;

a bias spring contained within said body between said shuttle and said bottom side of said body;

wherein said differential pressure control valve has an open position and a closed position, and wherein said open position allows fluid to flow from said topside of said body through said differential pressure control valve and through said upper conduit and wherein said closed position inhibits said flow and wherein said differential pressure control valve shifts to said closed position whenever the differential pressure between said topside and said lower conduit becomes nearly equal.

6. I claim a dual differential pressure control valve comprising:

a first body having a first inside, a first outside, a first topside adapted to receive fluid flow and a first bottom side;

a first upper and first lower conduit in communication with said first inside of said first body;

a first shuttle contained within said first body and adapted to move between said first topside and said first bottom side thereof;

a first bias spring contained within said first body between said first shuttle and said first bottom side of said first body;

a second body having a second inside, a second outside, a second topside and a second bottom side adapted to receive fluid flow;

a second upper and second lower conduit in communication with said second inside of said second body;

a second shuttle contained within said second body and adapted to move between said second topside and said second bottom side thereof;

a second bias spring contained within said second body between said second shuttle and said second bottom side of said second body;

wherein said first bottom of said first body is conjoined to said second top of said second body and wherein said dual differential pressure control valve has a first open position and a first closed position associated with said first body and a second open position and a second closed position associated with said second body, and wherein said first open position allows fluid to flow from said first topside of said first body through said differential pressure control valve and through said first upper conduit and wherein said closed position inhibits said flow and further wherein said differential pressure control valve shifts to said closed position whenever the differential pressure between said first topside and said first lower conduit becomes nearly equal and wherein said second open position allows fluid to flow from said second bottom side of said second body through said differential pressure control valve and through said second lower conduit and wherein said closed position inhibits said flow and further wherein said differential pressure control valve shifts to said closed position whenever the differential pressure between said second bottom side and said second upper conduit becomes nearly equal.

7. I claim a method for operating a gas lift system in a well having a wellhead, a casing, a production string within the casing and having a lift tube with a series of differential pressure control valves each having the same differential operation pressure placed within the production string and terminated at its distal end in an eduction pump and wherein the differential pressure control valves communicate between the lift tube and the fluid contained within the production string and wherein the lift tube is in communication with a recovery system and having a source of pressured gas comprising:

a. applying pressured gas to the production string;

b. allowing the pressured gas to force liquid from the production string through the first differential pressure control valve nearest the wellhead to the recovery system;

c. waiting until the first differential pressure control valve closes;

d. allowing the pressured gas to force liquid from the production string through the next differential pressure control valve nearest the wellhead to the recovery system;

e. waiting until the next differential pressure control valve closes;

f. repeating steps d and e until the last differential pressure control valve at the opposite end of the production string from the wellhead closes; and, g. producing the well through the eduction pump utilizing the pressured gas as a lift medium through the lift tube and to the recovery system.

8. I claim a method for operating a gas lift system in a well having a wellhead, a casing, and having a lift tube with a series of differential pressure control valves each having the same differential operation pressure placed within the casing and terminated at its distal end in an eduction pump and wherein the differential pressure control valves communicate between the lift tube and the fluid contained within the casing and wherein the lift tube is in communication with a recovery system and having a source of pressured gas comprising:

a. applying pressured gas to the casing:

b. allowing the pressured gas to force liquid from the casing through the first differential pressure control valve nearest the wellhead to the recovery system;

c. waiting until the first differential pressure control valve closes;

d. allowing the pressured gas to force liquid from the casing through the next differential pressure control valve nearest the wellhead to the recovery system;

e. waiting until the next differential pressure control valve closes;

d. repeating steps d and e until the last differential pressure control valve at the opposite end of the lift tube from the wellhead closes; and, e. producing the well through the eduction pump utilizing the pressured gas as a lift medium through the lift tube and to the recovery system.

9. I claim a method for reverse flushing a gas lift system in a well having a wellhead, surface plumbing, a casing, a production string within the casing and having a lift tube with a series of differential pressure control valves placed within the production string and terminated at its distal end in an eduction pump wherein the eduction pump has a check valve in the inlet and wherein the differential pressure control valves communicate between the lift tube and the fluid contained within the production string and wherein the lift tube is in communication with a recovery system which normally receives gas from the wellhead through the surface plumbing and having a source of pressured gas and water comprising:

a. reversing the surface plumbing thereby allowing the pumping of gas and fresh water down the lift tube, b. applying pressured gas and water into the lift tube thereby causing all differential control valves to open, c. circulating, under pressure, through the lift tube thereby carrying cleaning fluid through each differential pressure valve and returning said cleaning fluid to the surface through the production tubing, d. waiting for the flush process to finish, e. returning the surface plumbing to normal thereby allowing gas to flow up the lift tube through the wellhead and to the recovery system.

10. I claim the method of claim 9 wherein step cc is added immediately following step c:

cc. continuing the reverse flush process until the eduction pump is cleaned.

11. I claim a method for reverse flushing a gas lift system in a well having a wellhead, surface casing, a casing, and having a lift tube with a series of differential pressure control valves placed within the casing and terminated at its distal end in an eduction pump wherein the eduction pump has a check valve in the inlet and wherein the differential pressure control valves communicate between the lift tube and the fluid contained within the casing and wherein the lift tube is in communication with a recovery system which normally receives gas from the wellhead through surface plumbing and having a source of pressured gas and water comprising:

a. reversing the surface plumbing thereby allowing the pumping of gas and fresh water down the lift tube, b. applying pressured gas and water into the lift tube thereby causing all differential control valves to open, c. circulating, under pressure, through the lift tube thereby carrying cleaning fluid through each differential pressure valve and returning said cleaning fluid to the surface through the casing, d. waiting for the flush process to finish, e. returning the surface plumbing to normal thereby allowing gas to flow up the lift tube through the wellhead and to the recovery system.

12. I claim the method of claim 11 wherein step cc is added immediately following step c:

cc. continuing the reverse flush process until the eduction pump is cleaned.

* * * * *